US009334756B2

(12) United States Patent
Ring et al.

(10) Patent No.: US 9,334,756 B2
(45) Date of Patent: May 10, 2016

(54) LINER AND METHOD OF ASSEMBLY

(71) Applicant: United Technologies Corporation, Hartford, CT (US)

(72) Inventors: Mark David Ring, Cape Neddick, ME (US); David Cassella, Ogunquit, ME (US); Jonathan Earl, Wells, ME (US); Eric Kuehne, Lyman, ME (US); Charles Warner, South Portland, ME (US)

(73) Assignee: United Technologies Corporation, Hartford, CT (US)

( * ) Notice: Subject to any disclaimer, the term of this patent is extended or adjusted under 35 U.S.C. 154(b) by 735 days.

(21) Appl. No.: 13/656,906

(22) Filed: Oct. 22, 2012

(65) Prior Publication Data

US 2014/0093363 A1 Apr. 3, 2014

Related U.S. Application Data

(60) Provisional application No. 61/707,710, filed on Sep. 28, 2012.

(51) Int. Cl.

| | |
|---|---|
| ***F01D 9/04*** | (2006.01) |
| ***F01D 25/24*** | (2006.01) |
| ***F01D 11/00*** | (2006.01) |

(52) U.S. Cl.

CPC ..... *F01D 25/246* (2013.01); *F01D 9/041* (2013.01); *F01D 9/042* (2013.01); *F01D 11/003* (2013.01); *F05D 2220/32* (2013.01); *F05D 2240/12* (2013.01); *F05D 2240/90* (2013.01); *Y10T 29/49323* (2015.01)

(58) Field of Classification Search

CPC ..... F01D 9/04; F01D 9/041; F01D 9/042; Y10T 29/49321; Y10T 29/49323

USPC ..... 415/189, 190, 209.2–209.4, 210.1; 29/889.21, 889.22; 416/215–218

See application file for complete search history.

(56) References Cited

U.S. PATENT DOCUMENTS

| | | | | |
|---|---|---|---|---|
| 2,917,276 | A | | 12/1959 | Klompas et al. |
| 3,443,791 | A | | 5/1969 | Sevetz et al. |
| 3,656,822 | A | | 4/1972 | Schwartzman |
| 3,841,787 | A | * | 10/1974 | Scalzo ..... 415/136 |
| 4,274,805 | A | | 6/1981 | Holmes |
| 4,321,897 | A | | 3/1982 | Pelekis |
| 4,478,551 | A | | 10/1984 | Honeycutt, Jr. et al. |
| 4,648,792 | A | | 3/1987 | Baran, Jr. et al. |
| 4,863,678 | A | | 9/1989 | Shockling et al. |
| 4,989,406 | A | | 2/1991 | Vdoviak et al. |

(Continued)

FOREIGN PATENT DOCUMENTS

| | | |
|---|---|---|
| EP | 0225805 A1 | 6/1987 |
| EP | 0225805 B1 | 6/1987 |

(Continued)

OTHER PUBLICATIONS

The International Search Report mailed Dec. 9, 2013 for International Application No. PCT/US2013/058914.

*Primary Examiner* — Christopher Verdier

(74) *Attorney, Agent, or Firm* — Kinney & Lange, P.A.

(57) ABSTRACT

An assembly includes a plurality of vanes, a forward liner segment, and an aft liner segment. The forward liner segment and the aft liner segment are mounted to the plurality of vanes and each segment comprises an arc of less than 360° in length.

18 Claims, 5 Drawing Sheets

(56) References Cited

U.S. PATENT DOCUMENTS

| | | | | |
|---|---|---|---|---|
| 5,141,395 | A | 8/1992 | Carroll et al. | |
| 5,165,848 | A | 11/1992 | Plemmons | |
| 5,188,507 | A | 2/1993 | Sweeney | |
| 5,295,787 | A | 3/1994 | Leonard et al. | |
| 5,318,402 | A | 6/1994 | Bailey et al. | |
| 5,333,995 | A | 8/1994 | Jacobs et al. | |
| 6,152,698 | A | 11/2000 | Gregg et al. | |
| 6,202,302 | B1 | 3/2001 | Descoteaux | |
| 6,595,267 | B2 | 7/2003 | Didion et al. | |
| 6,711,900 | B1 | 3/2004 | Patel et al. | |
| 6,910,854 | B2 | 6/2005 | Joslin | |
| 6,925,809 | B2 | 8/2005 | Mowill | |
| 6,942,453 | B2 | 9/2005 | Tsuru et al. | |
| 7,278,821 | B1 | 10/2007 | O'Reilly et al. | |
| 7,303,372 | B2 | 12/2007 | West et al. | |
| 7,347,662 | B2 | 3/2008 | Balsdon | |
| 7,441,409 | B2 | 10/2008 | Patel et al. | |
| 7,549,845 | B2 | 6/2009 | Uwami et al. | |
| 7,572,098 | B1 | 8/2009 | Johnson | |
| 7,631,483 | B2 | 12/2009 | Mani et al. | |
| 8,040,007 | B2 | 10/2011 | Petrov et al. | |
| 2004/0169122 | A1 | 9/2004 | Dodd et al. | |
| 2008/0063520 | A1* | 3/2008 | Baumann | F01D 5/06 415/209.3 |
| 2010/0232940 | A1 | 9/2010 | Ammann | |
| 2010/0251692 | A1 | 10/2010 | Kinde, Sr. | |
| 2011/0005054 | A1 | 1/2011 | Maurell et al. | |
| 2011/0115223 | A1 | 5/2011 | Stahlkopf et al. | |
| 2012/0076659 | A1 | 3/2012 | Robertson | |
| 2012/0099969 | A1 | 4/2012 | Gilman | |
| 2012/0111012 | A1 | 5/2012 | Axelsson et al. | |
| 2012/0128482 | A1 | 5/2012 | Dezouche et al. | |
| 2013/0177400 | A1* | 7/2013 | Ring | 415/119 |
| 2013/0177401 | A1* | 7/2013 | Ring | 415/119 |
| 2013/0209248 | A1* | 8/2013 | Ring | F01D 25/246 415/209.3 |
| 2014/0060081 | A1* | 3/2014 | Earl et al. | 60/805 |

FOREIGN PATENT DOCUMENTS

| | | | | |
|---|---|---|---|---|
| EP | 0305159 | A2 | 3/1989 | |
| EP | 0305159 | A3 | 3/1989 | |
| EP | 0305159 | B1 | 3/1989 | |
| EP | 2236763 | A2 | 10/2010 | |
| GB | 2226600 | A | 7/1990 | |
| GB | 2441148 | A | 2/2008 | |
| GB | 2477825 | A9 * | 8/2011 | F01D 5/30 |
| JP | 2007292052 | A | 11/2007 | |
| WO | 2004070275 | A1 | 8/2004 | |
| WO | 2011106073 | A2 | 9/2011 | |
| WO | 2012007716 | A1 | 1/2012 | |

* cited by examiner

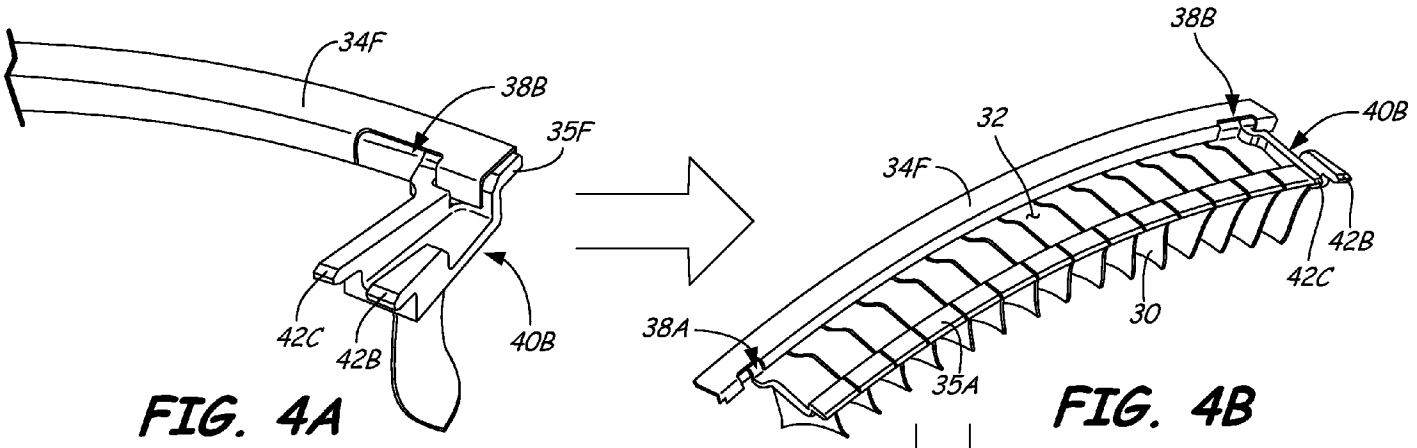
FIG. 4A
FIG. 4B
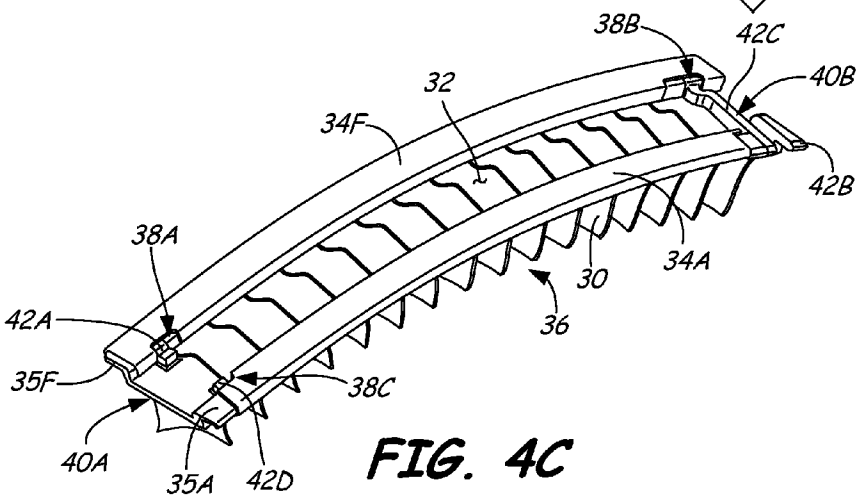
FIG. 4C

LINER AND METHOD OF ASSEMBLY

BACKGROUND

The present invention relates to gas turbine engines. More particularly, the present invention relates to liner segments for a gas turbine engine.

The operating environment for gas turbine engines is extremely harsh. Vibrations due to normal use at operating speeds are extreme. Additionally, the operating temperature experienced by some engine components is extremely high. Vanes are among the many components that experience wear in the engine due to vibrations and high temperature. Thus, liner segments between the vanes and an engine casing are used to reduce wear. However, current liner segment designs utilize a full ring which is initially mounted within the engine casing. Vanes are inserted into the liner segment and casing one vane at a time, which makes it difficult and time consuming to assemble and disassemble the vanes with the liner segment.

SUMMARY

An assembly includes a plurality of vanes, a forward liner segment, and an aft liner segment. The forward liner segment and the aft liner segment are mounted to the plurality of vanes and each segment comprises an arc of less than 360° in length.

A gas turbine engine includes a casing, a plurality of vanes, a first liner segment, and a second liner segment. The casing has first and second receptacles therein and the plurality of vanes are mounted within the first and second receptacles by first and second hooks. The first liner segment is mounted to the first hooks and disposed between the first hooks and the first receptacle and the second liner segment is mounted to the second hooks and disposed between the second hooks and the second receptacle. The first liner segment comprises a plurality of separate arc segments arranged to extend substantially 360° about the casing and the second liner segment comprises a plurality of separate arc segments arranged to extend substantially 360° about the casing.

A method of assembling a plurality of vane segments and a liner segment includes providing the liner segment with one or more slots, inserting a first end vane through the one or more slots, disposing the plurality of vanes along an arcuate length of the liner segment, and inserting both the plurality of vanes and the liner segment as an assembled unit into a receptacle of a casing so as to mount the assembled unit to the casing.

BRIEF DESCRIPTION OF THE DRAWINGS

FIGS. 4A-4D are perspective views illustrating one method of assembling vane packs and liner segments together for installation in gas turbine engine.

DETAILED DESCRIPTION

The present application discloses an arcuate liner segment where the liner segment is less than a full circular ring (360°) in length. Each segmented liner segment is mounted to a plurality of vanes of a gas turbine engine. The vanes and liner segment can be inserted as an assembly into a casing of a gas turbine engine. This configuration allows for quicker and easier installation and removal of the liner segment and vanes within the gas turbine engine. As the liner segment and vanes are installed and removed as a unit, the assembly also reduces the likelihood of foreign object damage to other components of the gas turbine engine, because the assembly eliminates the need for inserting or removing the vanes one vane at a time.

Figure 1:
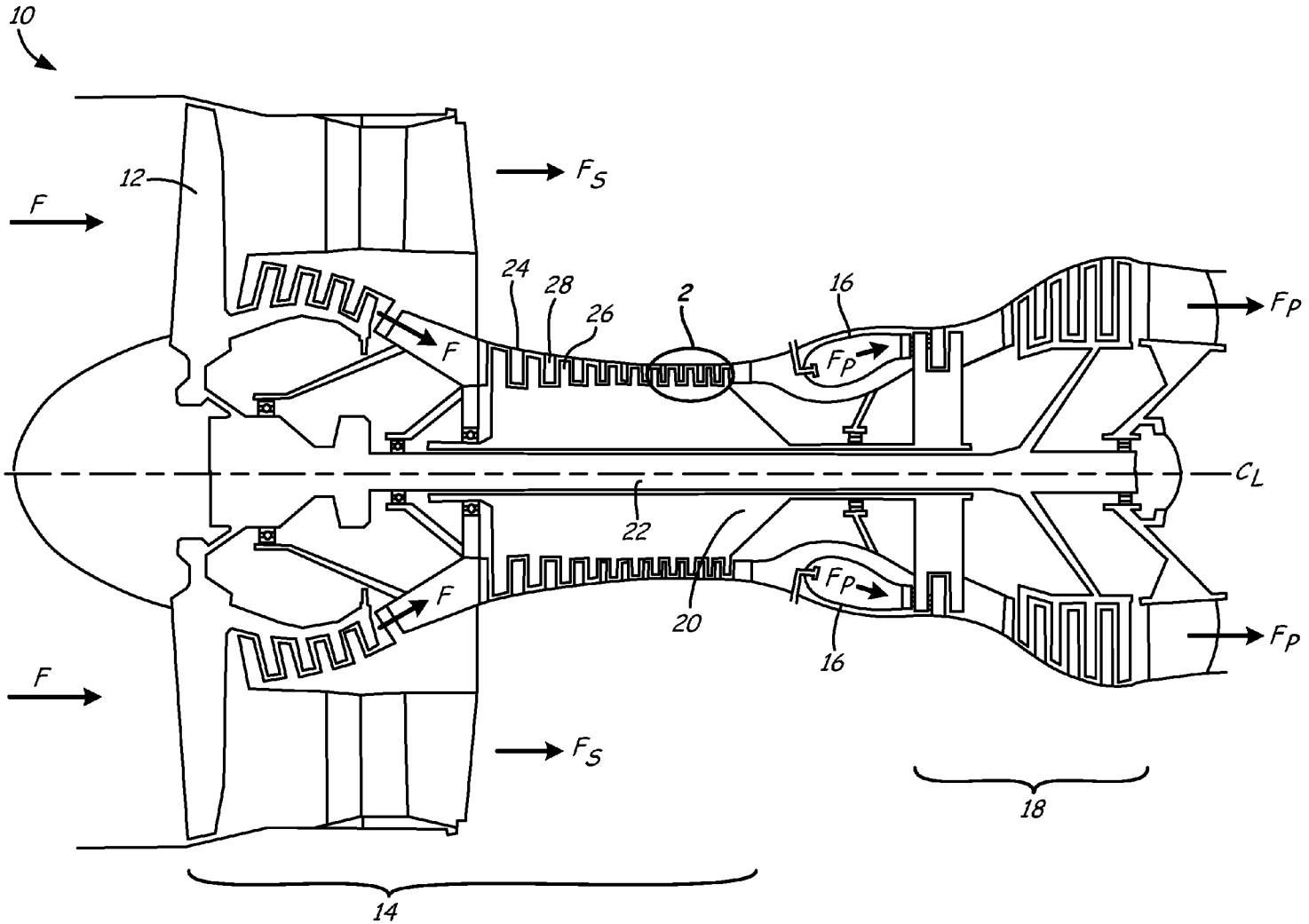
FIG. 1 is a cross-sectional view of a gas turbine engine according to an embodiment of the present invention.

FIG. 1 is a representative illustration of a gas turbine engine 10 including a liner/vane assembly of the present invention. The view in FIG. 1 is a longitudinal sectional view along an engine center line. FIG. 1 shows gas turbine engine 10 including a fan blade 12, a compressor 14, a combustor 16, a turbine 18, a high-pressure rotor 20, a low-pressure rotor 22, and an engine casing 24. Compressor 14 and turbine 18 include rotor stages 26 and stator stages 28.

As illustrated in FIG. 1, fan blade 12 extends from engine center line $C_L$ near a forward end of gas turbine engine 10. Compressor 14 is disposed aft of fan blade 12 along engine center line $C_L$, followed by combustor 16. Turbine 18 is located adjacent combustor 16, opposite compressor 14. High-pressure rotor 20 and low-pressure rotor 22 are mounted for rotation about engine center line $C_L$. High-pressure rotor 20 connects a high-pressure section of turbine 18 to compressor 14. Low-pressure rotor 22 connects a low-pressure section of turbine 18 to fan blade 12 and a high-pressure section of compressor 14. Rotor stages 26 and stator stages 28 are arranged throughout compressor 14 and turbine 18 in alternating rows. Thus, rotor stages 26 connect to high-pressure rotor 20 and low-pressure rotor 22. Engine casing 24 surrounds turbine engine 10 providing structural support for compressor 14, combustor 16, and turbine 18, as well as containment for air flow through engine 10.

In operation, air flow F enters compressor 14 after passing between fan blades 12. Air flow F is compressed by the rotation of compressor 14 driven by high-pressure turbine 18. The compressed air from compressor 14 is divided, with a portion going to combustor 16, a portion bypasses through fan 12, and a portion employed for cooling components, buffering, and other purposes. Compressed air and fuel are mixed and ignited in combustor 16 to produce high-temperature, high-pressure combustion gases Fp. Combustion gases Fp exit combustor 16 into turbine section 18.

Stator stages 28 properly align the flow of air flow F and combustion gases Fp for an efficient attack angle on subsequent rotor stages 26. The flow of combustion gases Fp past rotor stages 26 drives rotation of both low-pressure rotor 20 and high-pressure rotor 22. High-pressure rotor 20 drives a high-pressure portion of compressor 14, as noted above, and low-pressure rotor 22 drives fan blades 12 to produce thrust Fs from gas turbine engine 10.

Although embodiments of the present invention are illustrated for a turbofan gas turbine engine for aviation use, it is understood that the present invention applies to other aviation gas turbine engines and to industrial gas turbine engines as well.

Figure 2:
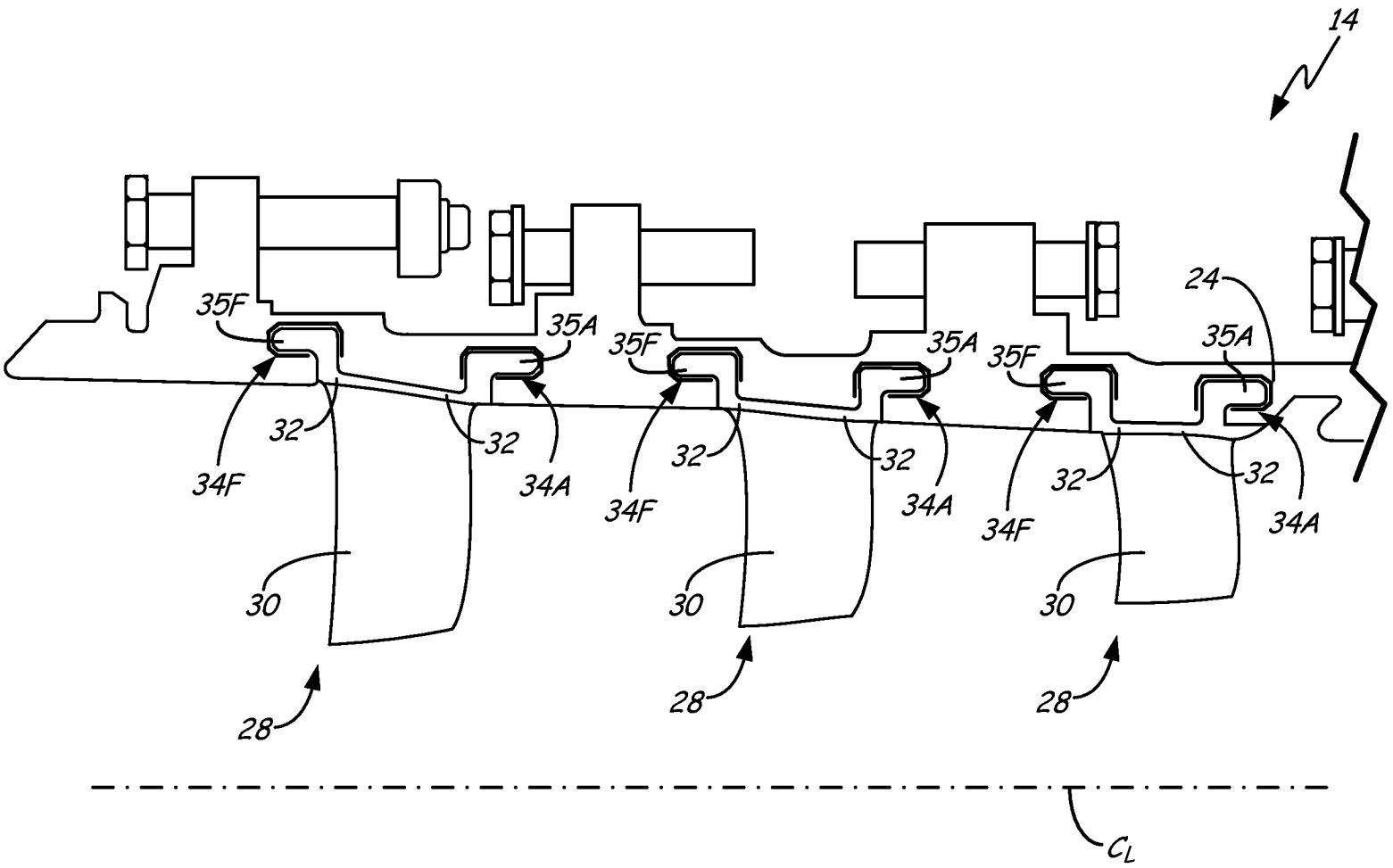
FIG. 2 is a cross-sectional view of one embodiment of a gas turbine engine compressor casing with a plurality of stator stages mounted therein.

FIG. 2 shows an exemplary portion of engine case 24 surrounding compressor 14. In addition to casing 24, FIG. 2 illustrates three stator stages 28 but does not illustrate rotor stages 26 (FIG. 1). Each stator stage 28 includes a vane 30 with a platform 32. Forward liner segments 34F and aft liner segments 34A are disposed between vanes 30 and casing 24.

Each stator stage 28 is comprised of a circumferential array of a plurality of vanes 30. Stator stages 28 are axially spaced from one another with respect to centerline axis $C_L$ of gas turbine engine 10 (FIG. 1). As shown in FIG. 2, vanes 30 comprise cantilevered vanes which extend radially inward from platforms 32 toward centerline axis $C_L$. In other embodiments, vanes 30 may be supported from both radial ends (with respect to centerline axis $C_L$) and vanes 30 may be disposed in other sections of gas turbine engine 10 such as turbine 18 (FIG. 1).

As will be discussed subsequently, platforms 32 are adapted with hooks that are disposed within casing 24 to allow vanes 30 to be supported therefrom. Forward and aft liner segments 34F and 34A are disposed between the casing 24 and platforms 32. Forward and aft liner segments 34F and 34A dampen vibration between vanes 30 and casing 24, accommodate thermal growth between platform 32 and casing 24, and allow for ease of assembly and disassembly of vanes 30 as a unit.

Figure 3:
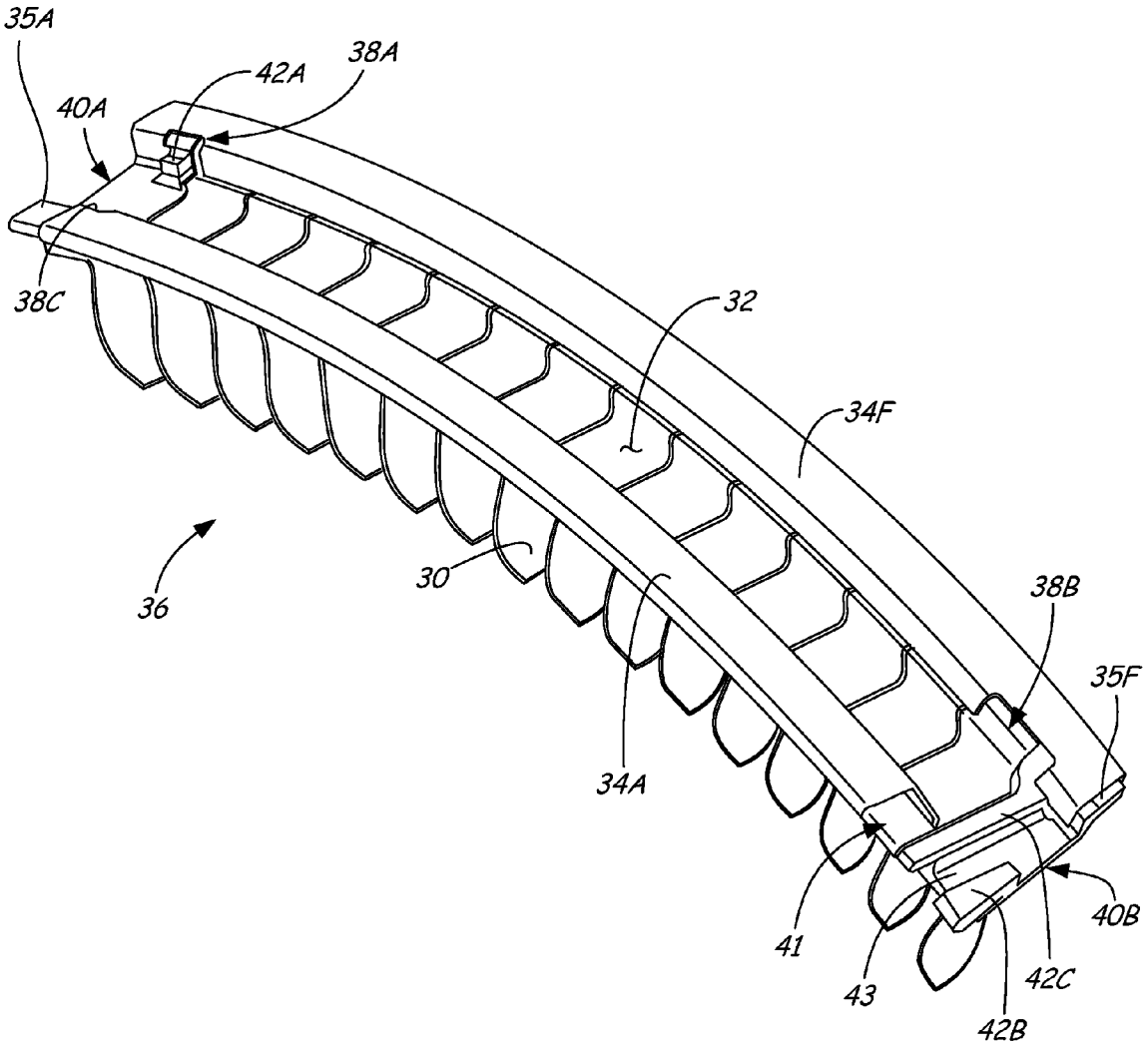
FIG. 3 is a perspective view of one embodiment of a vane pack with forward and aft liner segments mounted thereon.

FIG. 3 shows a plurality of vanes 30 each with platform 32. Vanes 30 are assembled adjacent one another to form a vane pack 36. Vanes 30 additionally include forward hooks 35F and aft hooks 35A. Forward liner segment 34F includes slots 38A and 38B. Aft liner segment 34A includes slot 38C. Vane pack 36 includes a first end vane 40A and a second end vane 40B. First end vane 40A includes a first standup 42A. Second end vane 40B includes a second standup 42B and a third standup 42C. Aft liner segment 34A is spaced from third standup 42C by a gap 41.

Vane pack 36 has of a plurality of adjacent abutting platforms 32 and extends between first end vane 40A at a first end and second end vane 40B at a second end. In the embodiment shown in FIG. 3, vane pack 36 comprises an arc that extends substantially 45° about centerline axis $C_L$ (FIGS. 1 and 2) of gas turbine engine 10 (FIG. 1). In other embodiments, the arc length of vane pack 36 and forward and aft liner segments 34F and 34A can vary in extent.

Aft hooks 35A and forward hooks 35F are disposed on opposing sides of platforms 32. Aft liner segment 34A is mounted to and extends laterally across aft hooks 35A of plurality of vanes 30. Similarly, forward liner segment 34F is mounted to and extends laterally across forward hooks 35F of plurality of vanes 30. Aft liner segment 34A comprises an arcuate segment that extends from first end vane 40A to adjacent second end vane 40B. Thus, aft liner segment 34A is disposed at a distance from second end vane 40B. Forward liner segment 34F comprises an arcuate segment that extends from first end vane 40A to second end vane 40B. As shown in FIG. 3, aft liner segment 34A and forward liner segment 34F comprise single-piece segments that form less than a complete circular ring within the inner circumference of casing 24 (FIGS. 1 and 2).

Slots 38A and 38B in forward liner segment 34F allow forward liner segment 34F to receive and be snap fit to first end vane 40A and second end vane 40B. Slot 38C in aft liner segment 34A allows aft liner segment 34A to receive and be snap fit to first end vane 40A and second end vane 40B. More particularly, slot 38A is adapted to receive and create an interference fit with first standup 42A of first end vane 40A. Slot 38B is adapted to receive and create an interference fit with third standup 42C of second end vane 40B.

Third standup 42C comprises a ridge that extends generally axially from forward hook 35F to aft hook 35A. Second standup 42B forms the aft hook for second end vane 40B and is adapted to abut the aft hook 35A of first end vane 40A when vane pack 36 is assembled adjacent a second vane pack 36.

Third standup 42C and second standup 42B are spaced from one another by slot 43. Slot 43 is adapted to receive a tab (not shown) in casing 24 (FIGS. 1 and 2). Tab (not shown) can engage third standup 42C and/or second standup 42B to provide a circumferential direction anti-rotation feature for vane pack 36 when installed in casing 24 (FIGS. 1 and 2).

Figure 4D:
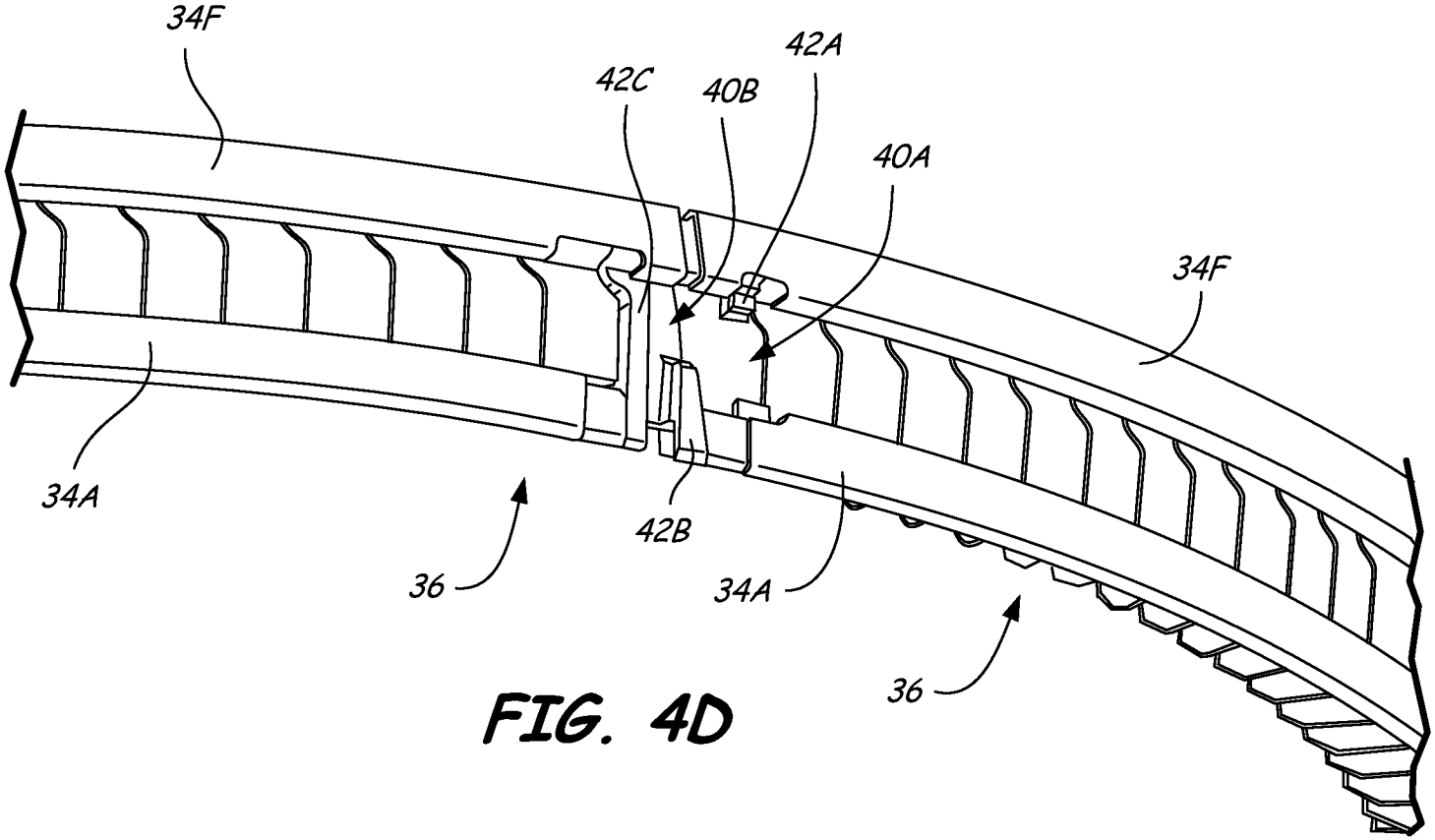

FIGS. 4A-4F show one method of assembling forward liner segment 34F and aft liner segment 34A with vane pack 36 for assembly in gas turbine engine 10 (FIG. 1). As illustrated in FIG. 4A, the method proceeds with second end vane 40B and forward liner segment 34F. Second end vane 40B is inserted through slot 38B until forward hook 35F contacts forward liner segment 34F. Second end vane 40B is moved laterally with respect to slot 38B until third standup 42C contacts a side surface of slot 38B as illustrated.

In FIG. 4B, individual vanes 30 are inserted in from a first open end of forward liner segment 34F and slide laterally toward second end vane 40B until platforms 32 contact one another. Vanes 30 are sequentially built out away from second end vane 40B and slot 38B with the insertion of each subsequent vane 30.

FIG. 4C illustrates vane pack 36 formed between first end vane 40A and second end vane 40B. Platforms 32 of vanes 30 abut one another and extend laterally in an arc between first end vane 40A and second end vane 40B. As shown in FIG. 4C, aft liner segment 34A has been inserted on aft hooks 35A of vanes 30. Aft liner segment 34A has slot 38C that is contacted by fourth standup 42D of first end vane 40A. Similarly, forward liner segment 34F includes slot 38A that receives and is in interference with first standup 42A. Together standups 42A, 42D, and 42C, act to retain forward and aft liner segments 34F and 34A to vane pack 36.

The assembly shown in FIG. 4C can be taken as an assembled unit and inserted into (or removed from) casing 24 (FIGS. 1 and 2). This configuration allows for quicker and easier installation and removal of liner segments 34A and 34F and vanes 30 within gas turbine engine 10 (FIG. 1). As the liner segments 34A and 34F and vane packs 36 are installed and removed as a unit, the assembly also reduces the likelihood of foreign object damage to other components of gas turbine engine 10 (FIG. 1) as the assembly eliminates the need for inserting or removing the vanes 30 from gas turbine engine 10 one vane at a time.

In FIG. 4D, casing 24 (FIGS. 1 and 2) is not shown to better illustrate the top of the assembly of vane packs 36 abutting one another. In this arrangement, second vane end 40B of one vane pack 36 abuts first vane end 40A of another vane pack 36 (the plurality of vane packs 36 are arranged circumferentially within casing 24 (FIGS. 1 and 2)). As shown, forward liner segments 34F and aft liner segments 34A comprise arc segments that are spaced from one another. Two or more of both forward liner segments 34F and aft liner segments 34A extend around the interior circumference of casing 24 (FIGS. 1 and 2), each liner segment 34F and 34A associated with a single vane pack 36.

The present application discloses an arcuate liner segment where the liner segment is less than a full circular ring (360°) in length. Each segmented liner segment is mounted to a plurality of vanes of a gas turbine engine. The vanes and liner segment can be inserted as an assembly into a casing of a gas turbine engine. This configuration allows for quicker and easier installation and removal of the liner segment and vanes within the gas turbine engine. As the liner segment and vanes are installed and removed as a unit, the assembly also reduces the likelihood of foreign object damage to other components of the gas turbine engine, because the assembly eliminates the need for inserting or removing the vanes one vane at a time.

DISCUSSION OF POSSIBLE EMBODIMENTS

The following are non-exclusive descriptions of possible embodiments of the present invention.

An assembly includes a plurality of vanes, a forward liner segment, and an aft liner segment. The forward liner segment and the aft liner segment are mounted to the plurality of vanes and each segment comprises an arc of less than 360° in length.

The assembly of the preceding paragraph can optionally include, additionally and/or alternatively, any one or more of the following features, configurations and/or additional components.

Each liner segment comprises a single-piece segment less than a complete circular ring.

The plurality of vanes are mounted adjacent one another to form a vane pack that comprises an arc that extends substantially 45° about a centerline axis of a gas turbine engine.

The plurality of vanes comprise cantilevered vanes.

The plurality of vanes are mounted adjacent one another to form a vane pack, and the vane pack has a first end vane at a first end and a second end vane at a second end.

Each liner segment includes one or more slots adapted to receive one or more standups of the first end vane and/or second end vane.

The one or more slots allows at least one of the first end vane or second end vane to be inserted therethrough.

At least one of the forward liner segment and the aft liner segment is disposed at a distance from the first end vane and/or the second end vane.

A first end vane of a first vane pack is adapted to interface with and a second end vane of a second vane pack.

The plurality of vanes include aft hooks and forward hooks, the aft liner segment is mounted to the aft hooks of the plurality of vanes, and the forward liner segment is mounted to the forward hooks of the plurality of vanes.

A gas turbine engine includes a casing, a plurality of vanes, a first liner segment, and a second liner segment. The casing has first and second receptacles therein and the plurality of vanes are mounted within the first and second receptacles by first and second hooks. The first liner segment is mounted to the first hooks and disposed between the first hooks and the first receptacle and the second liner segment is mounted to the second hooks and disposed between the second hooks and the second receptacle. The first liner segment comprises a plurality of separate arc segments arranged to extend substantially 360° about the casing and the second liner segment comprises a plurality of separate arc segments arranged to extend substantially 360° about the casing.

The plurality of vanes comprise an arcuate vane pack that extends substantially 45° about a centerline axis of the gas turbine engine, and each vane pack corresponds to one first liner segment and one second liner segment.

The plurality of vanes comprise an arcuate vane pack, and wherein the vane pack has a first end vane at a first end and a second end vane at a second end.

One or both of the first and second liner segment includes one or more slots adapted to receive one or more standups of the first end vane and/or second end vane.

The one or more slots allows at least one of the first end vane or second end vane to be inserted therethrough.

The first liner segment and the second liner segment comprise arcs of less than 360° in length.

A method of assembling a plurality of vane segments and a liner segment includes providing the liner segment with one or more slots, inserting a first end vane through the one or more slots, disposing the plurality of vanes along an arcuate length of the liner segment, and inserting both the plurality of vanes and the liner segment as an assembled unit into a receptacle of a casing so as to mount the assembled unit to the casing The method of the preceding paragraph can optionally include, additionally and/or alternatively, any one or more of the following features, configurations and/or additional components.

The plurality of vanes include aft hooks and forward hooks and the liner segment comprises a first liner segment and a second liner segment, wherein the first liner segment mounted to the aft hooks of the plurality of vanes, and wherein the second liner segment mounted to the forward hooks of the plurality of vanes.

Disposing a plurality of assemblies circumferentially within a casing of a gas turbine engine.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An assembly comprising:

a plurality of vanes each vane having an airfoil, a platform, and forward and aft mounting hooks; and a forward liner segment mounted on the forward mounting hooks of the plurality of vanes, wherein the forward liner segment extends around an axially forward side, an axially aft side, a radially inner side, and a radially outer side of the forward mounting hooks, and further wherein the forward liner segment is in contact with the axially aft side of the forward mounting hook; and an aft liner segment mounted to the aft mounting hooks of the plurality of vanes, wherein the aft liner segment extends around an axially forward side, an axially aft side, a radially inner side, and a radially outer side of the aft mounting hooks, wherein the forward liner segment and the aft liner segment are arcs of less than 360°, and further wherein the aft liner segment is in contact with the axially forward side of the aft mounting hook.

2. The assembly of claim 1, wherein each liner segment comprises a single-piece segment less than a complete circular ring.

3. The assembly of claim 1, wherein the plurality of vanes are mounted adjacent one another to form a vane pack that comprises an arc that extends substantially 45° about a centerline axis of a gas turbine engine.

4. The assembly of claim 1, wherein the plurality of vanes comprise cantilevered vanes.

5. The assembly of claim 1, wherein the plurality of vanes are mounted adjacent one another to form a vane pack, and wherein the vane pack has a first end vane at a first end and a second end vane at a second end.

6. The assembly of claim 5, wherein each liner segment includes one or more slots adapted to receive one or more standups of the first end vane and/or second end vane.

7. The assembly of claim 6, wherein the one or more slots allows at least one of the first end vane or second end vane to be inserted therethrough.

8. The assembly of claim 5, wherein at least one of the forward liner segment and the aft liner segment is disposed at a distance from the first end vane and/or the second end vane.

9. The assembly of claim 1, wherein a first end vane of a first vane pack is adapted to interface with a second end vane of a second vane pack.

10. A gas turbine engine comprising:

a casing with first and second receptacles therein;

a plurality of vane packs mounted within the casing and forming a circumferential stage, each vane pack comprising:

a plurality of vanes mounted within the first and second receptacles by first and second hooks;

a first liner segment mounted to the first hooks and disposed between the first hooks and the first receptacle, wherein the first liner segment extends around an axially forward side, an axially aft side, a radially inner side, and a radially outer side of the first hooks, and further wherein the first liner segment is in contact with the axially aft side of the first hooks; and a second liner segment mounted to the second hooks and disposed between the second hooks and the second receptacle, wherein the second liner segment extends around an axially forward side, an axially aft side, a radially inner side, and a radially outer side of the second hooks, wherein the first liner segment comprises a plurality of separate arc segments arranged to extend substantially 360° about the circumference of the casing and the second liner segment comprises a plurality of separate arc segments arranged to extend substantially 360° about the circumference of the casing, and further wherein the second liner segment is in contact with the axially forward side of the second hooks.

11. The gas turbine engine of claim 10, wherein each vane pack that extends substantially 45° about a centerline axis of the gas turbine engine, and wherein each vane pack corresponds to one first liner segment and one second liner segment.

12. The gas turbine engine of claim 10, wherein the vane pack has a first end vane at a first end and a second end vane at a second end.

13. The gas turbine engine of claim 12, wherein one or both of the first and second liner segment includes one or more slots adapted to receive one or more standups of the first end vane and/or second end vane.

14. The gas turbine engine of claim 13, wherein the one or more slots allows at least one of the first end vane or second end vane to be inserted therethrough.

15. The gas turbine engine of claim 10, wherein each of the first liner segment and the second liner segment are arcs of less than 360°.

16. A method of assembling a plurality of vane segments comprising:

assembling a forward liner segment and an aft liner segment with the plurality of vanes, wherein assembling a forward liner segment and an aft liner segment with the plurality of vanes further comprises:

inserting a forward mounting hook of a first end vane through a slot in the forward liner segment;

inserting an aft mounting hook of a first end vane through a slot in the aft liner segment;

positioning the forward liner segment to extend around an axially forward side, an axially aft side, a radially inner side, and a radially outer side of the forward mounting hook, wherein the forward liner segment is in contact with the axially aft side of the forward mounting hook;

positioning the aft liner segment to extend around an axially forward side, an axially aft side, a radially inner side, and a radially outer side of the aft mounting hook, wherein the aft liner segment is in contact with the axially forward side of the aft mounting hook;

contacting a standup of the first end vane with a surface of the slot; and positioning the remainder of the plurality of vanes along an arcuate length of the liner segment; and inserting the plurality of vanes, the forward liner segment, and the aft liner segment as an assembled unit into a receptacle of an engine casing of a gas turbine engine so as to mount the assembled unit to the engine casing.

17. The method of claim 16, wherein the step of assembling of the forward and aft liner segments with the plurality of vanes includes fitting a second end vane to the forward and aft liner segments at a second opposing side of the forward and aft liner segments from the first end vane.

18. The method of claim 16, further comprising disposing a plurality of assembled units circumferentially within the casing of the gas turbine engine to form a vane stage.

* * * * *